US009140524B2

(12) United States Patent
Fingerhut

(10) Patent No.: US 9,140,524 B2
(45) Date of Patent: Sep. 22, 2015

(54) MULTI-LAYERED BALLISTICS ARMOR

(75) Inventor: Richard L. Fingerhut, Tarzana, CA (US)

(73) Assignee: International Composites Technologies, Inc., Compton, CA (US)

( * ) Notice: Subject to any disclaimer, the term of this patent is extended or adjusted under 35 U.S.C. 154(b) by 182 days.

(21) Appl. No.: 12/703,710

(22) Filed: Feb. 10, 2010

(65) Prior Publication Data

US 2011/0192274 A1 Aug. 11, 2011

(51) Int. Cl.
*F41H 5/04* (2006.01)

(52) U.S. Cl.
CPC ..... *F41H 5/0435* (2013.01); *F41H 5/0457* (2013.01)

(58) Field of Classification Search
CPC ... F41H 5/0492; F41H 5/0428; F41H 5/0471; F41H 5/0442; F41H 5/04; F41H 5/023; F41H 5/02; F41H 5/0435
USPC ..... 89/36.02, 904, 906, 914, 915, 36.01; 428/911
See application file for complete search history.

(56) References Cited

U.S. PATENT DOCUMENTS

| | | | | |
|---|---|---|---|---|
| 3,406,229 | A | 10/1968 | Cenegy | |
| 3,965,942 | A | 6/1976 | Hatch | |
| 4,824,624 | A | 4/1989 | Palicka et al. | |
| 5,014,593 | A | 5/1991 | Auyer et al. | |
| 5,193,996 | A | 3/1993 | Mullen | |
| 5,221,807 | A | 6/1993 | Vives | |
| 5,484,652 | A | 1/1996 | Strunk et al. | |
| 5,683,281 | A | 11/1997 | Metter | |
| 5,759,688 | A | 6/1998 | Lee et al. | |
| 6,255,234 | B1 | 7/2001 | Erdemir et al. | |
| 6,389,594 | B1 * | 5/2002 | Yavin | 2/2.5 |
| 6,826,996 | B2 * | 12/2004 | Strait | 89/36.02 |
| 7,069,836 | B1 * | 7/2006 | Palicka et al. | 89/36.02 |
| 7,087,317 | B2 | 8/2006 | Ehrstrom et al. | |
| 7,357,062 | B2 | 4/2008 | Joynt | |
| 7,446,064 | B2 | 11/2008 | Hanks et al. | |
| 7,827,898 | B2 * | 11/2010 | Park et al. | 89/36.02 |
| 7,861,638 | B1 * | 1/2011 | Percival et al. | 89/36.02 |
| 7,866,248 | B2 * | 1/2011 | Moore et al. | 89/36.02 |
| 8,006,605 | B2 * | 8/2011 | Tunis et al. | 89/36.02 |
| 8,231,958 | B2 * | 7/2012 | Hoover et al. | 428/157 |
| 8,267,001 | B2 * | 9/2012 | Sayre et al. | 89/36.02 |

(Continued)

FOREIGN PATENT DOCUMENTS

EP 0699887 A2 9/1996

*Primary Examiner* — Samir Abdosh
*Assistant Examiner* — John D Cooper
(74) *Attorney, Agent, or Firm* — Fulwider Patton LLP

(57) ABSTRACT

The multi-layered ballistics armor includes one or more containment layers covering at least a portion of an impact absorbing layer formed of a fragmenting material to minimize and contain fragmentation of the impact absorbing layer. The one or more containment layers may include one or more primary containment envelopes, and the fragmenting material may be a ceramic such as silicon carbide, carbon/carbon composites, carbon/carbon/silicon carbide composites, boron carbide, aluminum oxide, silicon carbide particulate/aluminum metal matrix composites, or combinations thereof. The multi-layered armor may include one or more adhesive layers over the impact absorbing layer, one or more composite backing layers, an energy absorbing layer, and a flame resistant layer. A secondary containment envelope can be provided over the one or more primary containment envelopes, composite backing layers, and energy absorbing layer.

11 Claims, 7 Drawing Sheets

(56) References Cited

U.S. PATENT DOCUMENTS

| | | | | |
|---|---|---|---|---|
| 2004/0043181 | A1 | 3/2004 | Sherwood | |
| 2006/0065111 | A1* | 3/2006 | Henry | 89/36.02 |
| 2006/0137517 | A1 | 6/2006 | Palicka et al. | |
| 2006/0213360 | A1 | 9/2006 | Ravid et al. | |
| 2007/0034074 | A1 | 2/2007 | Ravid et al. | |
| 2008/0271595 | A1* | 11/2008 | Bird et al. | 89/36.02 |
| 2010/0043630 | A1* | 2/2010 | Sayre et al. | 89/36.02 |
| 2010/0083819 | A1* | 4/2010 | Mann et al. | 89/36.02 |
| 2011/0023695 | A1* | 2/2011 | van Heerden | 89/36.02 |
| 2011/0041675 | A1* | 2/2011 | Ermalovich | 89/36.02 |
| 2012/0174759 | A1* | 7/2012 | Gallo et al. | 89/36.02 |

* cited by examiner

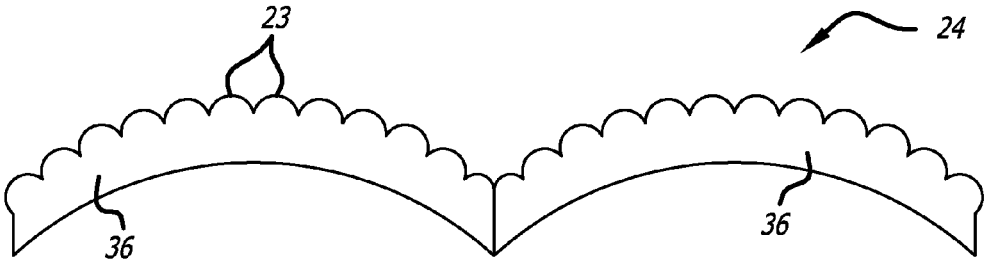
FIG. 12A
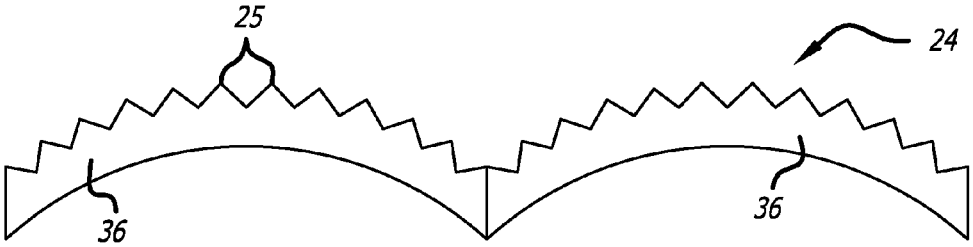
FIG. 12B
FIG. 13
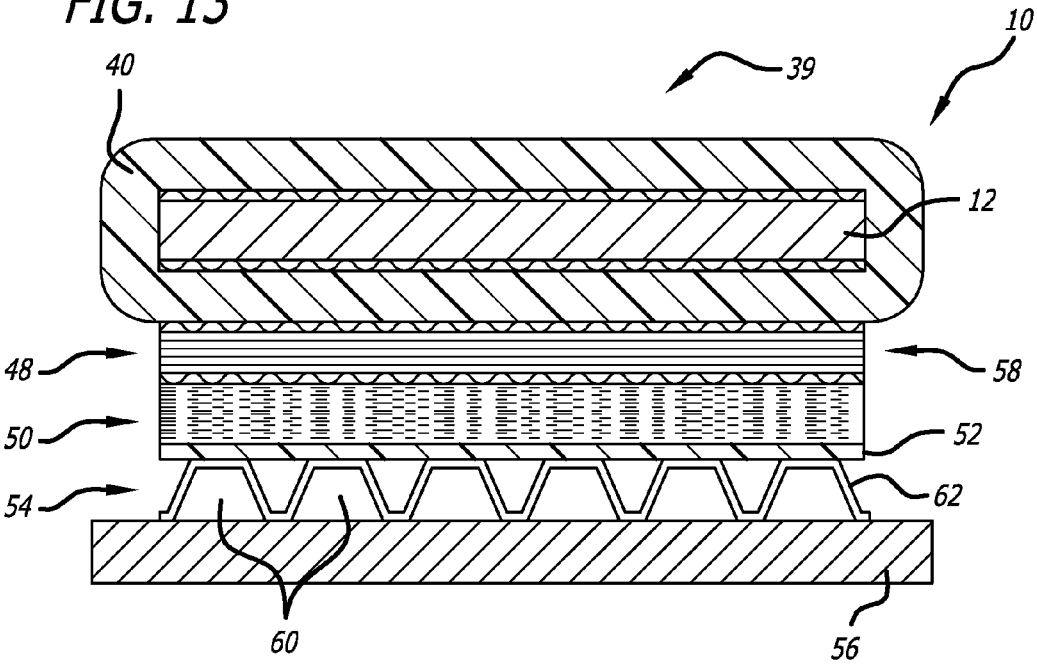

MULTI-LAYERED BALLISTICS ARMOR

BACKGROUND OF THE INVENTION

The present invention is relates generally to ballistic armor, and more particularly relates to a composite multi-layered ballistic armor stabilized to protect against fragmentation of the armor to provide improved protection against armor-piercing projectiles.

Conventional composite ballistic armor typically includes layers of different materials, and are commonly useful as armor for military vehicles. One advantage of such composite ballistic armor over all metal armor is that composite ballistic armor typically weighs less than metal armor of equivalent effectiveness, but so that composite armor can be stronger, lighter and less voluminous than traditional armor, but composite ballistic armor can also be designed to provide protection against armor-piercing projectiles such as high explosive anti-tank rounds.

One common type of modern composite armor includes a layer of ceramic between steel armor plates, which has proved to be effective in protecting tanks. One advantage of the use of a ceramic layer with steel armor plates is that the ceramic material absorbs projectile penetration by fragmentation, diminishing the penetration. There is a currently a need to provide reduced weight composite armor with the capability of providing protection against multiple ballistic impacts for use on vehicles lighter than tanks, buildings, and even as personal body armor by individuals. However, it has been found that following an initial ballistic impact the effectiveness of conventional ceramic armor can quickly deteriorate significantly due to the inherent fragmentation of ceramic armor when subjected to shock waves or shear forces of a ballistic impact. A need therefore remains for a composite ballistic armor with the capability of providing protection against multiple ballistic impacts. The present invention meets this and other needs.

SUMMARY OF THE INVENTION

Briefly and in general terms, the present invention provides for a multi-layered ballistics armor stabilized to minimize fragmentation of the armor, to minimize deterioration of the armor when subjected to shock waves or shear forces of a ballistic impact, to provide improved protection against multiple ballistic impacts.

Accordingly, the present invention provides for a multi-layered ballistics armor that includes an impact absorbing layer formed of a fragmenting material that typically undergoes spalling when subjected to the shock waves and shear forces of a ballistic impact. At least one containment layer is provided covering at least a portion of the impact absorbing layer to minimize and contain fragmentation of the impact absorbing layer, such as a primary containment envelope covers at least a portion of the impact absorbing layer to minimize and contain fragmentation of the impact absorbing layer. In a presently preferred aspect, the fragmenting material may be a ceramic formed of a material such as silicon carbide, carbon/carbon composites, carbon/carbon/silicon carbide composites, boron carbide, aluminum oxide, silicon carbide particulate/aluminum metal matrix composites, or combinations thereof, for example. The fragmenting material can be formed as a monolithic plate, or a plurality of interfitting plates, such as a plurality of interfitting square or rectangular plates, or interfitting hexagonal plates, for example. The monolithic plate can be a flat planar plate, ridged or grooved planar plate, a curved plate, or a ridged or grooved curved plate, for example; and the interfitting plates can be flat planar interfitting plates, ridged or grooved interfitting planar plates, or curved interfitting plates, ridged or grooved interfitting curved plates, for example.

In another aspect, one or more adhesive layers optionally may be provided, to coat one or more sides of the impact absorbing layer. The adhesive can be an elastomer coating, a thermosetting material, a thermoplastic material, a flame resistant material, or resin, or combinations thereof, for example. The multi-layered armor also optionally may include a flame resistant layer, such as a layer of phenolic material or polyurea, or a combination thereof, for example.

In another presently preferred aspect, one or more primary containment envelopes are provided that can be formed with a primary containment resin matrix configured to provide an outer covering over at least the strike face or front impact receiving side and the rear side of the impact absorbing layer. One or more composite backing layers may also be provided over at least one of the strike face or front impact receiving side and the rear side of the one or more primary containment envelopes, and in a presently preferred aspect, the one or more composite backing layers include a backing layer resin matrix, which may the same or different from the resin matrix of the one or more primary containment envelopes. The primary containment resin matrix and the backing layer resin matrix may each be formed of a fibrous material and a ballistic adhesive compatible resin. The fibrous material can be carbon fiber, fiberglass, aramid fiber, ultra high molecular weight polyethylene, liquid crystal polymers, or combinations thereof, for example, and the ballistic adhesive compatible resin can be epoxy phenolic resin, vinyl ester resin, ultraviolet curing resins, thermoplastic resin, thermoset resin, polyethylene, ionomer resin, polypropylene, carbon fiber reinforced polyphenylene sulfide anti-ballistic resin, polyurea, polyurethane, or combinations thereof, for example. The resin matrixes also optionally may include nano particle fillers.

In a presently preferred aspect, the one or more composite backing layers may include an energy absorbing layer secured to the rear side of the one or more primary containment envelopes. The energy absorbing layer can be formed of a material such as uniwoven material, woven material, aramid fiber, ultra high molecular weight polyethylene, fiberglass, and polyethylene, or combinations thereof, for example. In another currently preferred aspect, a ductile adhesive layer may be disposed between the energy absorbing layer and the one or more composite backing layer. The energy absorbing layer may also include a flame resistant layer, which can be made of a phenolic material or polyurea, or a combination thereof, for example. A standoff spacer layer defining one or more chambers or cells, such as a honeycomb, foam, a hat stiffened panel, or even spaced apart bolts, for example, can also be provided, opposing the strike face, between the one or more primary containment envelopes and the substrate surface. The one or more chambers or cells can be filled with a filler or air.

In another presently preferred aspect, a secondary containment envelope can be provided over at least a portion of the one or more primary containment envelopes. The secondary containment envelope is preferably formed covering at the least the front and rear sides of the primary containment envelope, composite backing layer and energy absorbing layer. A flame resistant layer may also be provided over at least a portion of the secondary containment envelope. A standoff spacer layer defining one or more chambers or cells filled with a filler or air may also be provided opposing the strike face, between the secondary containment envelope and the substrate surface.

The present invention also provides for a method of manufacturing multi-layered armor stabilized to minimize fragmentation of the armor, by providing an impact absorbing layer and one or more primary containment envelopes covering at least a portion of the impact absorbing layer. The one or more primary containment envelopes preferably are provided over at least the strike face or front impact receiving side and a rear side of the impact absorbing layer, to minimize and contain fragmentation of the impact absorbing layer. One or more adhesive layers also may optionally be provided coating at least one of the strike face or front impact receiving side and the rear side of the impact absorbing layer. In a presently preferred aspect, the one or more primary containment envelopes can be formed by placing a containment resin matrix around the impact absorbing layer, such as by wrapping a fibrous material in a containment resin matrix around the impact absorbing layer, and allowing the containment resin matrix to cure. One or more composite backing layers may also be provided over the one or more primary containment envelopes, and can include an energy absorbing layer, an outer flame resistant layer, and a standoff spacer layer.

The secondary containment envelope can be provided over at least a portion of the one or more primary containment envelopes, such as over at least a front side and a rear side of the impact absorbing layer to minimize and contain fragmentation of the impact absorbing layer. An adhesive layer may be provided over one or both of the strike face or front impact receiving side and the rear side of the impact absorbing layer. One or more composite backing layers can be also be placed over the rear side of the one or more primary containment envelopes, with an optional layer of adhesive between the rear side of the primary containment envelope and the one or more composite backing layers, which can include an energy absorbing layer, and a flame resistant layer. A ductile adhesive layer optionally may be placed between the energy absorbing layer and the one or more composite backing layer. The secondary containment envelope is preferably formed over at least a portion of the primary containment envelope, composite backing layer and energy absorbing layer, such as at least the front and rear sides of the primary containment envelope, composite backing layer and energy absorbing layer, such as by wrapping a fibrous material in a containment resin matrix around the impact absorbing layer, and allowing the containment resin matrix to cure. A flame resistant layer may also be formed over at least a portion of the secondary containment envelope. A standoff spacer layer defining one or more chambers or cells filled with a filler or air may also be provided opposing the strike face, between the secondary containment envelope and the substrate surface.

Other features and advantages of the present invention will become more apparent from the following detailed description of the preferred embodiments in conjunction with the accompanying drawings, which illustrate, by way of example, the operation of the invention.

BRIEF DESCRIPTION OF THE DRAWINGS

FIG. 12A is a schematic diagram of a side view of an impact absorbing layer of the multi-layered armor of the first or second embodiments of present invention formed of a plurality of ridged or grooved interfitting curved plates having rounded ridges.

FIG. 12B is a schematic diagram of a side view of an impact absorbing layer of the multi-layered armor of the first or second embodiments of present invention formed of a plurality of ridged or grooved interfitting curved plates having dentate ridges.

FIG. 13 is a schematic cross-sectional diagram illustrating addition of a standoff spacer layer between a primary containment envelope and the substrate surface.

DETAILED DESCRIPTION OF THE PREFERRED EMBODIMENTS

While composite armor including a layer of ceramic between steel armor plates can be effective, there is a need to provide reduced weight composite armor, and it has been found that ceramic armor can quickly deteriorate significantly after a single ballistic impact to reduce the multiple impact protection of such ceramic based ballistics armor.

Figure 5:
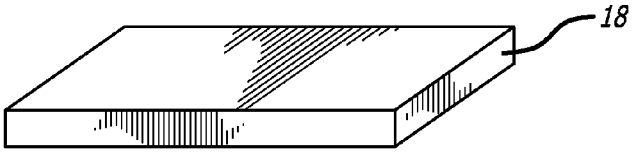
FIG. 5 is a schematic diagram of an impact absorbing layer of the multi-layered armor of the first or second embodiments of present invention formed of a flat planar monolithic plate.
Figure 6:
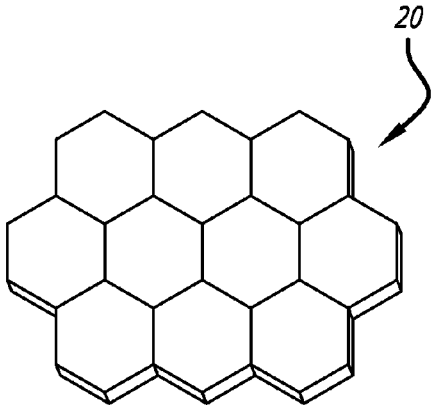
FIG. 6 is a schematic diagram of an impact absorbing layer of the multi-layered armor of the first or second embodiments of present invention formed of a plurality of flat planar interfitting plates.
Figure 7A:
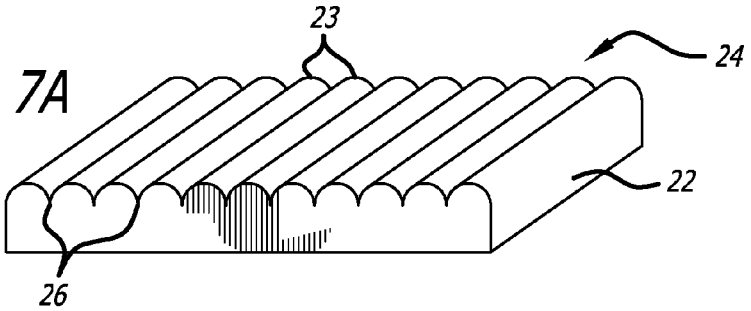
FIG. 7A is a schematic diagram of an impact absorbing layer of the multi-layered armor of the first or second embodiments of present invention formed of a ridged and grooved planar monolithic plate with rounded ridges.
Figure 7B:
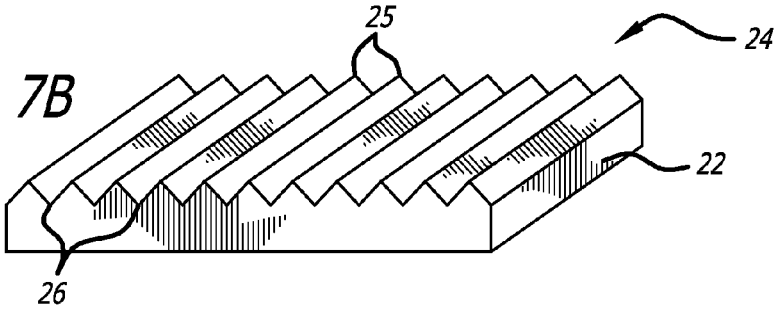
FIG. 7B is a schematic diagram of an impact absorbing layer of the multi-layered armor of the first or second embodiments of present invention formed of a ridged and grooved planar monolithic plate with dentate ridges.
Figure 8:
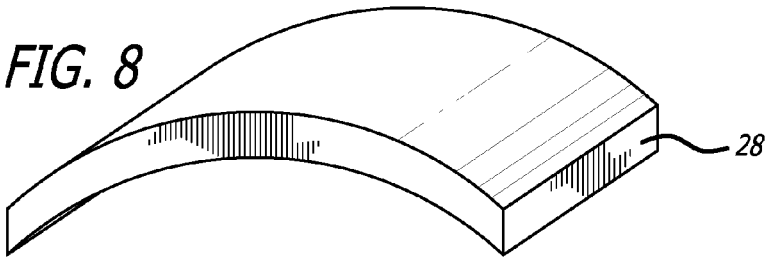
FIG. 8 is a schematic diagram of an impact absorbing layer of the multi-layered armor of the first or second embodiments of present invention formed of a curved monolithic plate.
Figure 9A:
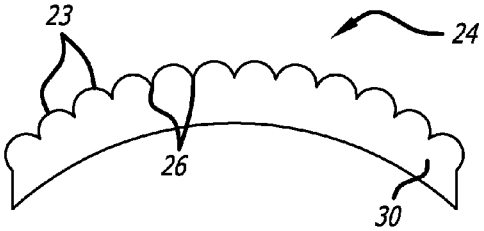
FIG. 9A is a schematic diagram of a side view of an impact absorbing layer of the multi-layered armor of the first or second embodiments of present invention formed of a ridged and grooved curved monolithic plate with rounded ridges.
Figure 9B:
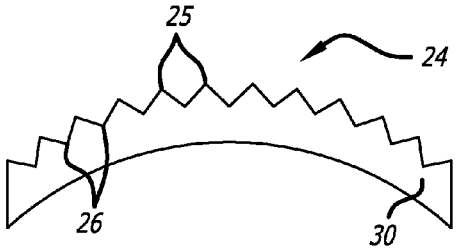
FIG. 9B is a schematic diagram of a side view of an impact absorbing layer of the multi-layered armor of the first or second embodiments of present invention formed of a ridged and grooved curved monolithic plate with dentate ridges.
Figure 10A:
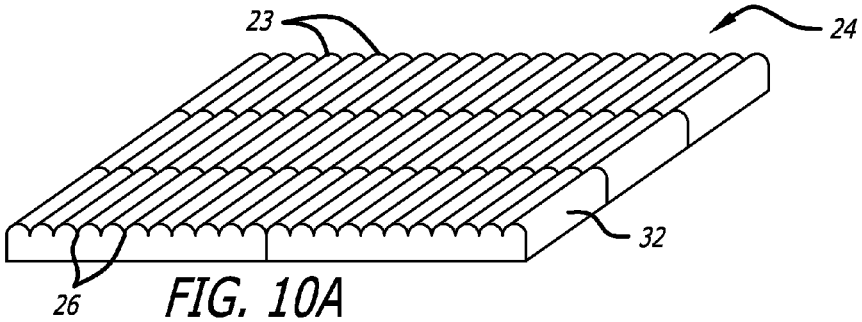
FIG. 10A is a schematic diagram of an impact absorbing layer of the multi-layered armor of the first or second embodiments of present invention formed of a plurality of ridged and grooved interfitting planar plates having rounded ridges.
Figure 10B:
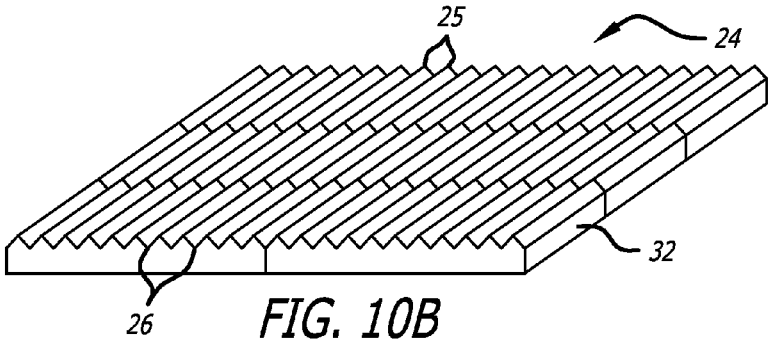
FIG. 10B is a schematic diagram of an impact absorbing layer of the multi-layered armor of the first or second embodiments of present invention formed of a plurality of ridged and grooved interfitting planar plates having dentate ridges.
Figure 11:
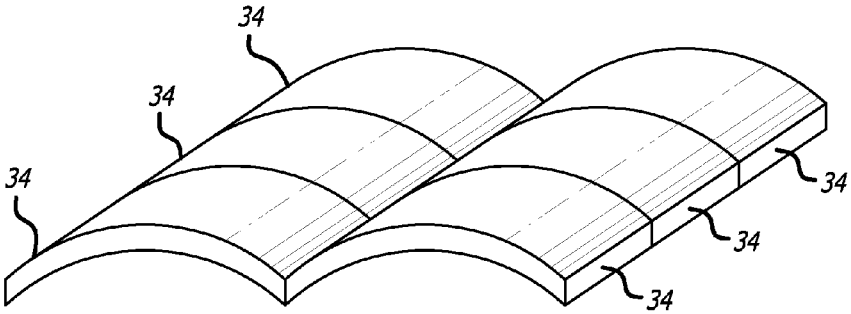
FIG. 11 is a schematic diagram of an impact absorbing layer of the multi-layered armor of the first or second embodiments of present invention formed of a plurality of curved interfitting plates.

Accordingly, as is illustrated in the drawings, which are provided by way of example and not by way of limitation, the present invention provides for a multi-layered armor 10 stabilized to protect against fragmentation of the armor. The multi-layered armor includes an impact absorbing layer 12 having a strike face or front impact receiving side 14 and a rear side 16, so that a projectile received by the multi-layered armor proceeds from the front impact receiving side in a rearward direction toward the rear side. The multi-layered armor is preferably formed of a fragmenting material that is subject to fragmentation, spalling and splintering in dissipating a ballistic impact, due to shock waves and/or shear forces generated by the force of the ballistic impact. The fragmenting material can be formed as a monolithic plate 18, such as the flat planar monolithic plate illustrated in FIG. 5, or a plurality of interfitting plates, such as a plurality of flat planar interfitting square or rectangular plates, for example, or flat planar interfitting hexagonal plates 20, illustrated in FIG. 6, for example. The monolithic plate can also be formed as a ridged and/or grooved planar plate 22 with ridges 24 and/or grooves 26, as is illustrated in FIG. 7A showing rounded ridges 23 and FIG. 7B showing dentate ridges 25, or a curved plate 28 illustrated in FIG. 8, or a ridged and/or grooved curved plate 30 with ridges 24 and/or grooves 26, illustrated in FIG. 9A showing rounded ridges 23 and FIG. 9B showing dentate ridges 25. Similarly, the interfitting plates can be ridged and/or grooved interfitting planar plates 32 with ridges 24 and/or grooves 26, as is illustrated in FIG. 10A showing rounded ridges 23 and FIG. 10B showing dentate ridges 25, or curved interfitting plates 34 as is illustrated in FIG. 11, or ridged and/or grooved interfitting curved plates 36 with ridges 24 and/or grooves 26 as is illustrated in FIG. 12A showing rounded ridges 23 and FIG. 12B showing dentate ridges 25, for example. The fragmenting material itself can be selected from the group of ceramic materials including silicon carbide (SiC), carbon/carbon composites available from Hitco Carbon Composites, Inc. of Gardena, Calif., carbon/carbon/silicon carbide composites available from Hitco Carbon Composites, Inc. of Gardena, Calif., boron carbide ($B_4C$), aluminum oxide ($Al_2O_3$), and SiCp (silicon carbide particulate)/aluminum metal matrix composites (MMC), and combinations thereof.

Figure 1:
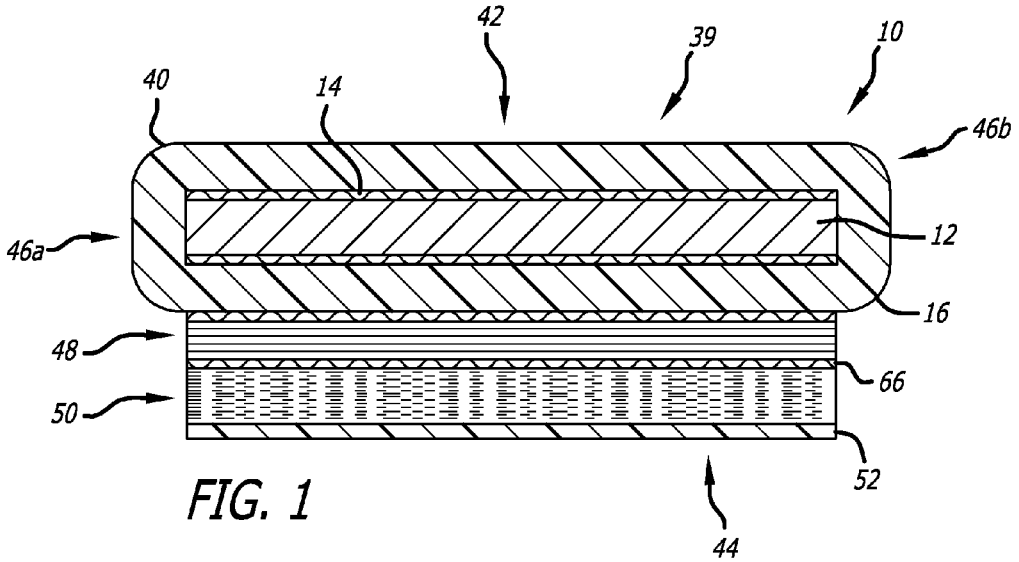
FIG. 1 is a schematic cross-sectional diagram of a first embodiment of a multi-layered armor according to the present invention, including an impact absorbing layer and at least one primary containment envelope covering at least a portion of the impact absorbing layer.
Figure 2:
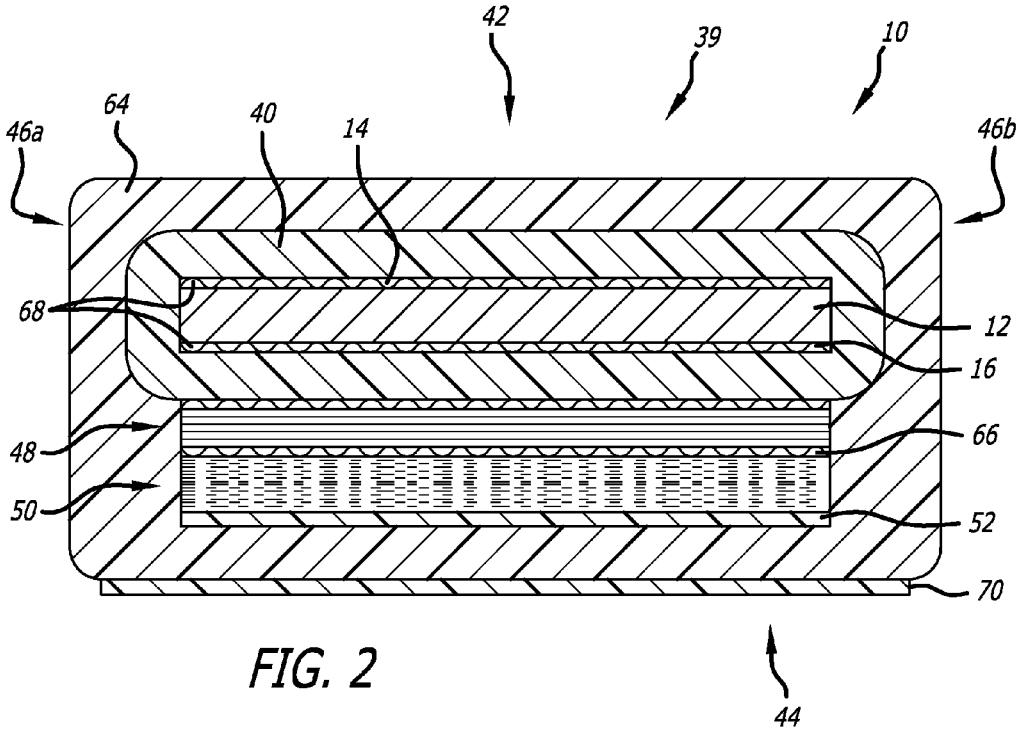
FIG. 2 is a schematic cross-sectional diagram of a second embodiment of a multi-layered armor according to the present invention, including an impact absorbing layer and at least one primary containment envelope covering at least a portion of the impact absorbing layer, and including a secondary containment envelope covering at least a portion of the primary containment envelope and an energy absorbing layer.

As is illustrated in FIGS. 1 and 2, the multi-layered armor also preferably includes one or more containment layers 39 covering at least a portion of the impact absorbing layer, such as one or more primary containment envelopes 40 enclosing the impact absorbing layer, providing an outer covering over at least a strike face or front impact receiving side 42 of the impact absorbing layer, and an opposing or rear side 44 of the impact absorbing layer, so as to minimize and contain fragmentation of the impact absorbing layer. As is shown in FIGS. 1 and 2, the one or more primary containment envelopes may also have first and second lateral sides 46*a*, 46*b*, which in a presently preferred aspect cover the first and second lateral sides of the impact absorbing layer, to minimize and contain fragmentation of the impact absorbing layer. The one or more primary containment envelopes are preferably formed by a primary containment resin matrix, which typically also includes a fibrous material. The primary containment resin matrix, can for example be formed of a fibrous material and a ballistic adhesive compatible resin. The fibrous material can be carbon fiber, fiberglass, aramid fiber, ultra high molecular weight polyethylene (UHMWPE) available under the trademark "DYNEEMA" from DSM of the Netherlands, and available from Honeywell under the brand name "SPECTRA," liquid crystal polymers, or combinations thereof, for example. The ballistic adhesive compatible resin can be epoxy phenolic resin, vinyl ester resin, ultraviolet curing resins, thermoplastic resin, thermoset resin, polyethylene, ionomer resin, polypropylene, carbon fiber reinforced polyphenylene sulfide anti-ballistic resin, polyurea, polyurethane, or combinations thereof, for example. The primary containment resin matrix also may optionally include nano particle fillers.

One or more composite backing layers 48 may be provided over one or both of the strike face or front impact receiving side 42 of the one or more primary containment envelopes and the rear side 44 of the one or more primary containment envelopes. Typically the one or more composite backing layers include a backing layer resin matrix, which can be the same or different from the primary containment resin matrix, and also can for example be formed of a fibrous material and a ballistic adhesive compatible resin. The fibrous material also can be carbon fiber, fiberglass, aramid fiber, ultra high molecular weight polyethylene (UHMWPE) available under the trademark "DYNEEMA" from DSM of the Netherlands, and available from Honeywell under the brand name "SPECTRA," liquid crystal polymers, or combinations thereof, for example. The ballistic adhesive compatible resin also can be epoxy phenolic resin, vinyl ester resin, ultraviolet curing resins, thermoplastic resin, thermoset resin, polyethylene, ionomer resin, polypropylene, carbon fiber reinforced polyphenylene sulfide anti-ballistic resin, polyurea, polyurethane, or combinations thereof, for example. The backing layer resin matrix also may optionally include nano particle fillers.

In another presently preferred aspect, the one or more composite backing layers may also include an energy absorbing layer 50 that is typically secured to the rear side of the one or more primary containment envelopes. The energy absorbing layer is typically formed of an energy absorbing material, which can be uniwoven material, woven material, aramid fiber, ultra high molecular weight polyethylene, fiberglass, polyethylene, or combinations thereof, for example. The energy absorbing layer may also include a flame resistant layer 52, which can be made of a phenolic material or polyurea, or a combination thereof, for example.

Figure 14:
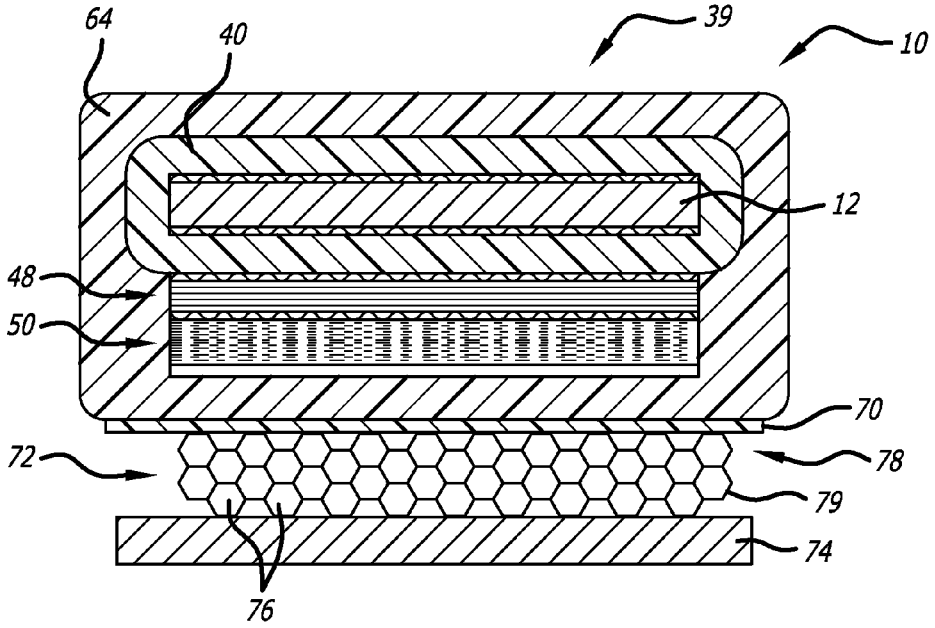
FIG. 14 is a schematic cross-sectional diagram illustrating addition of a standoff spacer layer between a secondary containment envelope and the substrate surface.

Referring to FIG. 13, a standoff spacer layer 54 can also be provided between the one or more primary containment envelopes and a substrate surface 56 on the opposing or rear side 58 of the one or more primary containment envelopes opposing the strike face, and defining a space with one or more chambers or cells 60, such as one or more hat stiffened panels 62, a honeycomb structure, shown in FIG. 14, closed cell or open cell foam, such as polyurethane foams or extruded polystyrene foam for example, or even a series of spaced apart bolts, for example. The one or more chambers or cells can be filled, such as with a gas such as carbon dioxide or nitrogen, or air, for example.

Referring to FIG. 2, in an other presently preferred aspect, the one or more containment layers may also include a secondary containment envelope 64 that covers at least a portion of the one or more primary containment envelopes, and at least a portion of the energy absorbing layer, when present. The secondary containment envelope is preferably formed by a secondary containment resin matrix, which typically also includes a fibrous material. The secondary containment resin matrix can for example be formed of a fibrous material and a ballistic adhesive compatible resin. The fibrous material can be carbon fiber, fiberglass, aramid fiber, ultra high molecular weight polyethylene (UHMWPE), liquid crystal polymers, or combinations thereof, for example, and the ballistic adhesive compatible resin can be epoxy phenolic resin, vinyl ester resin, ultraviolet curing resins, thermoplastic resin, thermoset resin, polyethylene, ionomer resin, polypropylene, carbon fiber reinforced polyphenylene sulfide anti-ballistic resin, polyurea, polyurethane, or combinations thereof, for example. The secondary containment resin matrix also may optionally include nano particle fillers.

A ductile adhesive layer 66 may be disposed between the energy absorbing layer, when present, and the one or more composite backing layers. The ductile adhesive layer can be formed of the same material as the backing layer resin matrix, or can be a ballistic adhesive compatible resin, such as a rubberized, a pressure-sensitive adhesive material, a thermoset material, a ductile thermoplastic material, or a resin rich layer with backing, and may also be flame resistant.

In another presently preferred aspect, one or more adhesive layers 68 may be provided, coating at least one of the strike face or front impact receiving side and the rear side of the impact absorbing layer. The one or more adhesive layers can for example be an elastomer coating, a thermosetting material, a thermoplastic material, a flame resistant material, or resin, or combinations thereof, for example. In another presently preferred aspect, the multi-layer ballistic armor can further include a flame resistant layer 70, which can be formed of a phenolic material or polyurea, or a combination thereof, for example.

Referring to FIG. 14, a standoff spacer layer 72 can also be provided between the secondary containment envelope and a substrate surface 74, defining a space with one or more chambers or cells 76 on the opposing or rear side 78 of the secondary containment envelope opposing the strike face, such as one or more hat stiffened panels as shown in FIG. 13, a honeycomb structure 79, closed cell or open cell foam, such as polyurethane foams or extruded polystyrene foam for example, or even a series of spaced apart bolts, for example. The one or more chambers or cells can be filled, such as with a gas such as carbon dioxide or nitrogen, or air, for example.

Figure 3:
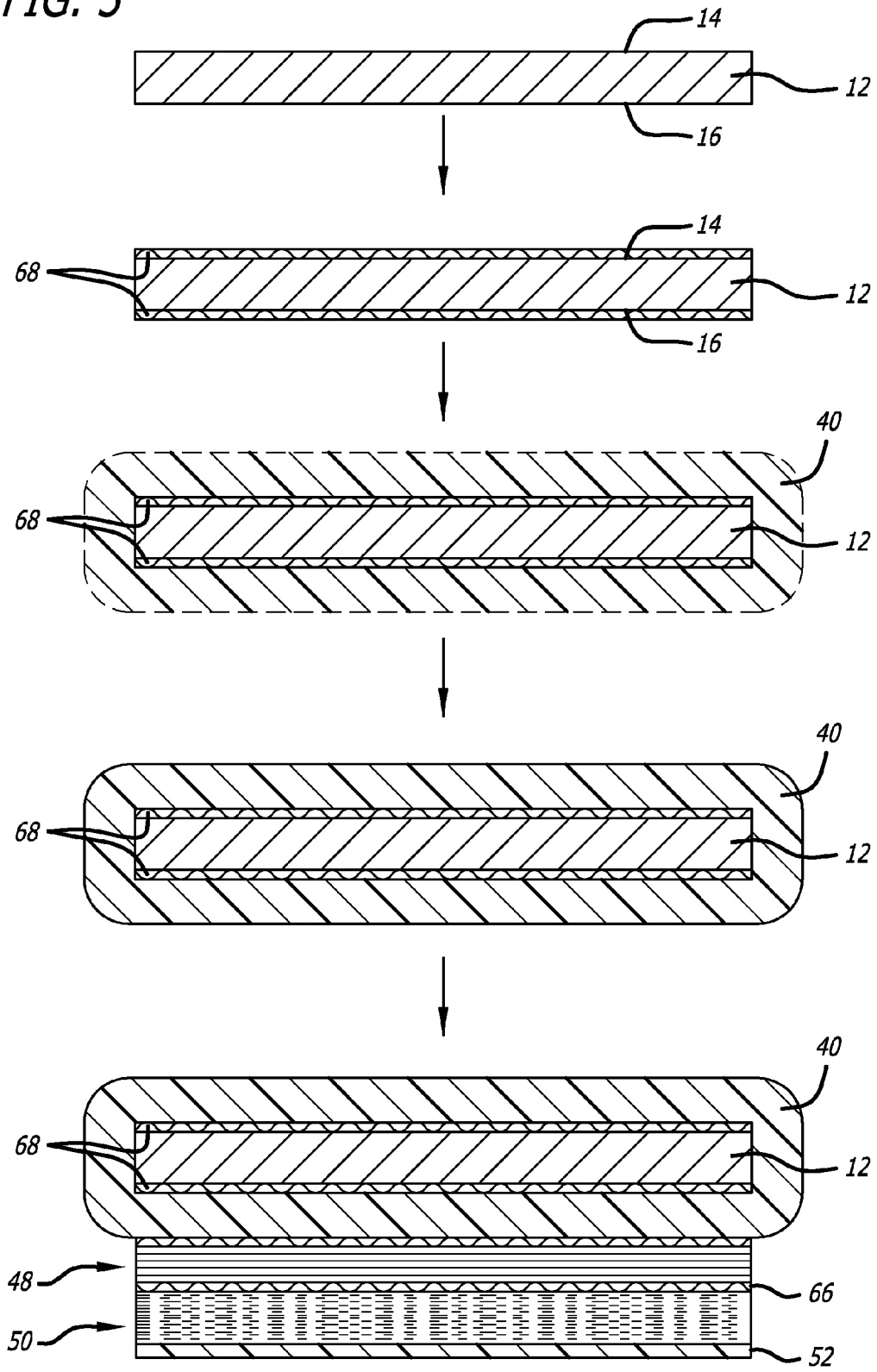
FIG. 3 is a flow diagram illustrating a method of manufacturing the multi-layered armor of FIG. 1.

Referring to FIG. 3, in the basic method of the invention for manufacturing the multi-layered armor of FIG. 1, an impact absorbing layer 12 is provided, formed of a fragmenting material, and having a strike face or front impact receiving side 14 and a rear side 16. As is illustrated in FIG. 3, one or more adhesive layers 68 may optionally be provided over one or both of the front and rear sides of the impact absorbing layer, coating at least one of the strike face or front impact receiving side and the rear side of the impact absorbing layer. One or more primary containment envelopes 40 are provided to cover at least a portion of the impact absorbing layer, including at least the strike face or front impact receiving side, and the rear side, to minimize and contain fragmentation of the impact absorbing layer. The one or more primary containment envelopes 40 can be formed over the impact absorbing layer, for example, by wrapping a fibrous material in a containment resin matrix around the impact absorbing layer. The containment resin matrix is then allowed to cure. One or more composite backing layers 48 optionally can be added over one or both of the strike face or front impact receiving side and the rear side of the impact absorbing layer, and the one or more composite backing layers may also include an energy absorbing layer 50, and a flame resistant layer 52.

Figure 4:
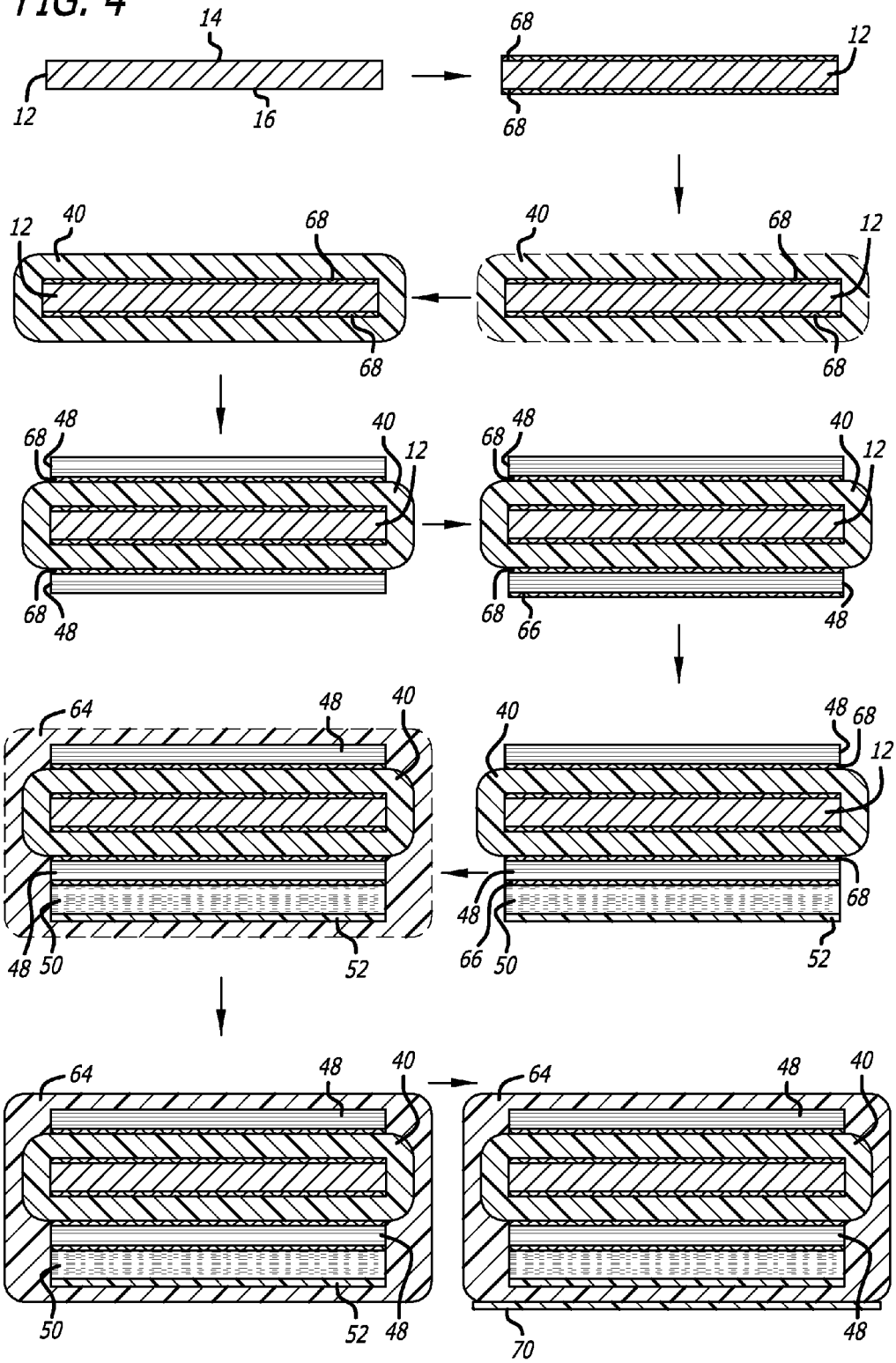
FIG. 4 is a flow diagram illustrating a method of manufacturing the multi-layered armor of FIG. 2.

Referring to FIG. 4, the present invention provides a method for manufacturing a multilayered armor including a primary containment envelope 40 and a secondary containment envelope 64. The primary containment envelope is formed to cover at least a portion of an impact absorbing layer 12 formed of a fragmenting material according to the invention, and having a strike face or front impact receiving side, and a rear side. The primary containment envelope preferably is formed to cover at least the front impact receiving side and a rear side of the impact absorbing layer, to minimize and contain fragmentation of the impact absorbing layer. As described above, the one or more primary containment envelopes can be formed over the impact absorbing layer, for example, by wrapping a fibrous material in a primary containment resin matrix around the impact absorbing layer, and allowing the primary containment resin matrix to cure.

One or more adhesive layers 68 may optionally be provided over one or both of the front and rear sides of the impact absorbing layer, and one or more composite backing layers 48 optionally can be added over one or both of the strike face or front impact receiving side and the rear side of the impact absorbing layer.

A ductile adhesive layer 66 optionally may be placed between the energy absorbing layer and the one or more composite backing layers. The ductile adhesive layer can be formed of the same material as the backing layer resin matrix, or can be a ballistic adhesive compatible resin, such as a rubberized, a pressure-sensitive adhesive material, a thermoset material, a ductile thermoplastic material, or a resin rich layer with backing, and may also be flame resistant. The secondary containment envelope is preferably formed over at least a portion of the primary containment envelope, composite backing layer and energy absorbing layer, such as at least the front and rear sides of the primary containment envelope, composite backing layer and energy absorbing layer. A flame resistant layer may also be formed over at least a portion of the secondary containment envelope.

The secondary containment envelope can be formed by wrapping a fibrous material in a secondary containment resin matrix over at least a portion of the primary containment envelope 40 and at least a portion of the energy absorbing layer, and allowing the secondary containment resin matrix to cure. The secondary containment resin matrix can for example be formed of a fibrous material and a ballistic adhesive compatible resin. The fibrous material can be carbon fiber, fiberglass, aramid fiber, ultra high molecular weight polyethylene (UHMWPE), liquid crystal polymers, or combinations thereof, for example, and the ballistic adhesive compatible resin can be epoxy phenolic resin, vinyl ester resin, ultraviolet curing resins, thermoplastic resin, thermoset resin, polyethylene, ionomer resin, polypropylene, carbon fiber reinforced polyphenylene sulfide anti-ballistic resin, polyurea, polyurethane, or combinations thereof, for example. The secondary containment resin matrix also may optionally include nano particle fillers.

Figure 15:
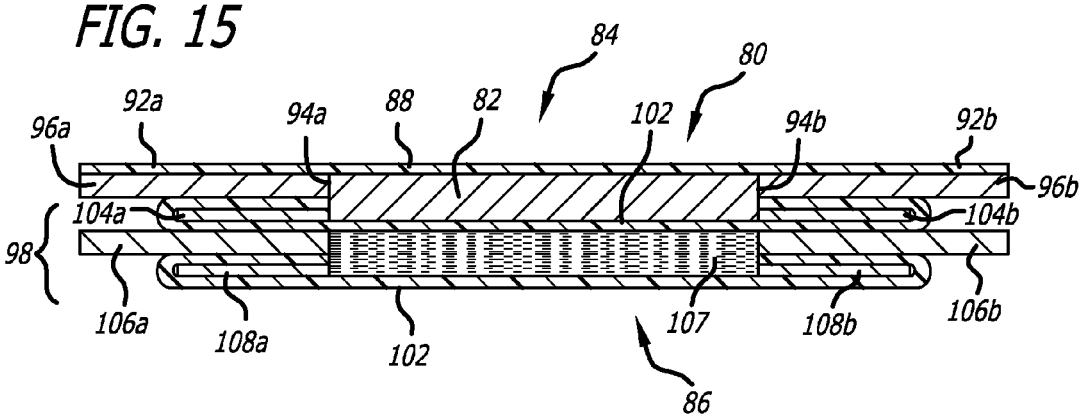
FIG. 15 is a schematic cross-sectional diagram of a third embodiment of a multi-layered armor according to the present invention, including an impact absorbing layer and a containment layer covering at least a portion of the impact absorbing layer.

Referring to FIG. 15, in a third presently preferred embodiment, the present invention provides for a multi-layered armor 80 stabilized to protect against fragmentation of the armor. The multi-layered armor includes an impact absorbing layer 82 having a strike face or front impact receiving side 84 and a rear side 86, so that a projectile received by the multi-layered armor proceeds from the front impact receiving side in a rearward direction toward the rear side. The multi-layered armor is preferably formed of a fragmenting material that is subject to fragmentation, spalling and splintering in dissipating a ballistic impact, due to shock waves and/or shear forces generated by the force of the ballistic impact. The fragmenting material can be formed as a monolithic plate 18, such as the flat planar monolithic plate illustrated in FIG. 5, or a plurality of interfitting plates, such as a plurality of flat planar interfitting square or rectangular plates, for example, or flat planar interfitting hexagonal plates 20, illustrated in FIG. 6, for example. The monolithic plate can also be formed as a ridged and/or grooved planar plate 22 with ridges 24 and/or grooves 26, as is illustrated in FIG. 7A showing rounded ridges 23 and FIG. 7B showing dentate ridges 25, or a curved plate 28 illustrated in FIG. 8, or a ridged and/or grooved curved plate 30 with ridges 24 and/or grooves 26, illustrated in FIG. 9A showing rounded ridges 23 and FIG. 9B showing dentate ridges 25. Similarly, the interfitting plates can be ridged and/or grooved interfitting planar plates 32 with ridges 24 and/or grooves 26, as is illustrated in FIG. 10A showing rounded ridges 23 and FIG. 10B showing dentate ridges 25, or curved interfitting plates 34 as is illustrated in FIG. 11, or ridged and/or grooved interfitting curved plates 36 with ridges 24 and/or grooves 26 as is illustrated in FIG. 12A showing rounded ridges 23 and FIG. 12B showing dentate ridges 25, for example. The fragmenting material itself can be selected from the group of ceramic materials including silicon carbide (SiC), carbon/carbon composites available from Hitco Carbon Composites, Inc. of Gardena, Calif., carbon/carbon/silicon carbide composites available from Hitco Carbon Composites, Inc. of Gardena, Calif., boron carbide ($B_4C$), aluminum oxide ($Al_2O_3$), and SiCp (silicon carbide particulate)/aluminum metal matrix composites (MMC), and combinations thereof. The fragmenting material is preferably selected from the group of ceramic materials consisting of silicon carbide (SiC), boron carbide ($B_4C$), aluminum oxide ($Al_2O_3$), and SiCp (silicon carbide particulate)/aluminum metal matrix composites (MMC), and combinations thereof.

As is illustrated in FIG. 15, the multi-layered armor also preferably includes one or more containment layers covering at least a portion of the impact absorbing layer, such as a containment layer 88 providing an outer covering over the strike face or front impact receiving side of the impact absorbing layer, so as to minimize and contain fragmentation of the impact absorbing layer. The containment layer preferably includes first and second lateral sides 92*a*, 92*b*, which in a presently preferred aspect extend beyond the first and second lateral sides 94*a*, 94*b* of the impact absorbing layer, and retain first and second primary metal strips or plates 96*a*, 96*b* adjacent to the first and second lateral sides of the impact absorbing layer, to minimize and contain fragmentation of the impact absorbing layer. The containment layer is preferably formed by a containment resin matrix, which typically also includes a fibrous material. The containment resin matrix can for example be formed of a fibrous material and a ballistic adhesive compatible resin. The fibrous material can be carbon fiber, fiberglass, aramid fiber, ultra high molecular weight polyethylene (UHMWPE), liquid crystal polymers, or combinations thereof, for example, and the ballistic adhesive compatible resin can be epoxy phenolic resin, vinyl ester resin, ultraviolet curing resins, thermoplastic resin, thermoset resin, polyethylene, ionomer resin, polypropylene, carbon fiber reinforced polyphenylene sulfide anti-ballistic resin, polyurea, polyurethane, or combinations thereof, for example. The containment resin matrix also may optionally include nano particle fillers.

One or more composite backing layers 98 may be provided over the rear side of the impact absorbing layer. Typically the one or more composite backing layers include a fibrous material 102 which can be aramid fiber, such as three or more plies of aramid fiber available under the trademark KEVLAR 745 or KEVLAR 754 from E. I. du Pont de Nemours and Company, although other similar materials such as carbon fiber, fiberglass, ultra high molecular weight polyethylene (UHMWPE), liquid crystal polymers, or combinations thereof, for example, may also be suitable. The fibrous material can be provided on the rear side of the impact absorbing layer and wrapped around primary strips 104*a*, 104*b* of aluminum or steel disposed rearwardly of and abutting the first and second primary metal strips or plates adjacent to the first and second lateral sides of the impact absorbing layer. Similarly, first and second secondary metal strips or plates 106*a*, 106*b* can be provided rearwardly of and abutting the wrapped primary strips of aluminum or steel, on either side of a plurality of layers of the fibrous material 107, such as a multi-ply stack of approximately a forty-ply stack of 0/90° non-crimp aramid fiber material, or TFlex-H, for example. The fibrous material can be provided on the rear side of the plurality of layers of the fibrous material multi-ply stack and wrapped around secondary strips 108*a*, 108*b* of aluminum or steel disposed rearwardly of and abutting the first and second secondary metal strips or plates. The wrapped primary and secondary strips of aluminum or steel and the primary and secondary metal strips or plates further can be bolted together, respectively.

Figure 16:
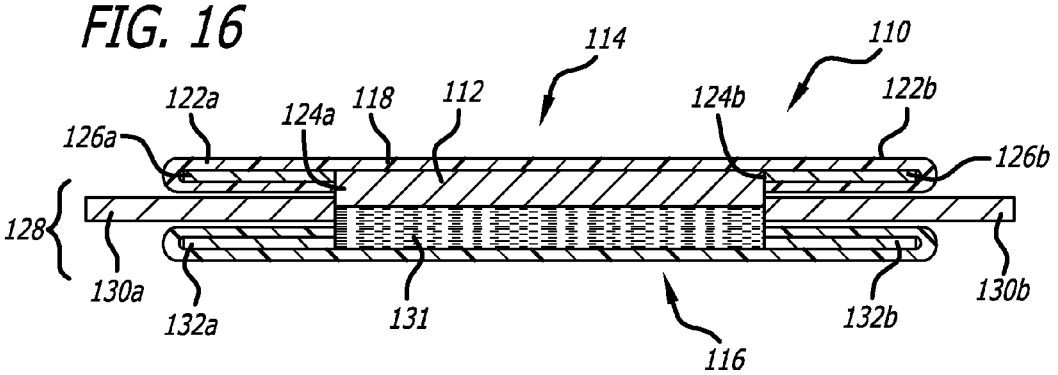
FIG. 16 is a schematic cross-sectional diagram of a third embodiment of a multi-layered armor according to the present invention, including an impact absorbing layer and a containment layer covering at least a portion of the impact absorbing layer.

Referring to FIG. 16, in a fourth preferred embodiment, the present invention provides for a multi-layered armor 110 stabilized to protect against fragmentation of the armor. The multi-layered armor includes an impact absorbing layer 112 having a strike face or front impact receiving side 114 and a rear side 116, so that a projectile received by the multi-layered armor proceeds from the front impact receiving side in a rearward direction toward the rear side. The multi-layered armor is preferably formed of a fragmenting material that is subject to fragmentation, spalling and splintering in dissipating a ballistic impact, due to shock waves and/or shear forces generated by the force of the ballistic impact. The fragmenting material can be formed as a monolithic plate 18, such as the flat planar monolithic plate illustrated in FIG. 5, or a plurality of interfitting plates, such as a plurality of flat planar interfitting square or rectangular plates, for example, or flat planar interfitting hexagonal plates 20, illustrated in FIG. 6, for example. The monolithic plate can also be formed as a ridged and/or grooved planar plate 22 with ridges 24 and/or grooves 26, as is illustrated in FIG. 7A showing rounded ridges 23 and FIG. 7B showing dentate ridges 25, or a curved plate 28 illustrated in FIG. 8, or a ridged and/or grooved curved plate 30 with ridges 24 and/or grooves 26, illustrated in FIG. 9A showing rounded ridges 23 and FIG. 9B showing dentate ridges 25. Similarly, the interfitting plates can be ridged and/or grooved interfitting planar plates 32 with ridges 24 and/or grooves 26, as is illustrated in FIG. 10A showing rounded ridges 23 and FIG. 10B showing dentate ridges 25, or curved interfitting plates 34 as is illustrated in FIG. 11, or ridged and/or grooved interfitting curved plates 36 with ridges 24 and/or grooves 26 as is illustrated in FIG. 12A showing rounded ridges 23 and FIG. 12B showing dentate ridges 25, for example. The fragmenting material itself is preferably selected from the group of ceramic materials consisting of silicon carbide (SiC), boron carbide ($B_4C$), aluminum oxide ($Al_2O_3$), and SiCp (silicon carbide particulate)/aluminum metal matrix composites (MMC), and combinations thereof.

As is illustrated in FIG. 16, the multi-layered armor also preferably includes one or more containment layers covering at least a portion of the impact absorbing layer, such as a containment layer 118 providing an outer covering over the strike face or front impact receiving side of the impact absorbing layer, so as to minimize and contain fragmentation of the impact absorbing layer. The containment layer preferably includes first and second lateral sides 122*a*, 122*b*, which in a presently preferred aspect extend beyond the first and second lateral sides 124*a*, 124*b* of the impact absorbing layer and wrapped around primary strips 126*a*, 126*b* of aluminum or steel adjacent to the first and second lateral sides of the impact absorbing layer, to minimize and contain fragmentation of the impact absorbing layer. The containment layer is preferably formed by a fibrous material, which for example can be three or more plies of aramid fiber available under the trademark KEVLAR 745 from E. I. du Pont de Nemours and Company, although other similar materials such as carbon fiber, fiberglass, ultra high molecular weight polyethylene (UHMWPE), liquid crystal polymers, or combinations thereof, for example, may also be suitable.

One or more composite backing layers 128 may be provided over the rear side of the impact absorbing layer. First and second metal strips or plates 130*a*, 130*b* can be provided rearwardly of and abutting the wrapped primary strips of aluminum or steel, on either side of a plurality of layers of the fibrous material 131, such as a multi-ply stack of approximately a forty-ply stack of 0/90° non-crimp aramid fiber material, or TFlex-H, for example. The fibrous material can be provided on the rear side of the plurality of layers of the fibrous material multi-ply stack and wrapped around secondary strips 132*a*, 132*b* of aluminum or steel disposed rearwardly of and abutting the first and second metal strips or plates. The wrapped primary and secondary strips of aluminum or steel and the metal strips or plates further can be bolted together, respectively.

It will be apparent from the foregoing that while particular forms of the invention have been illustrated and described, various modifications can be made without departing from the spirit and scope of the invention. Accordingly, it is not intended that the invention be limited, except as by the appended claims.

I claim:

1. A multi-layered armor stabilized to minimize fragmentation of the armor, comprising:

an impact absorbing layer having a front impact receiving side, a rear side, and first and second lateral sides, said impact absorbing layer including a monolithic plate of fragmenting material;

a containment layer covering said impact receiving side, rear side, and first and second lateral sides of said impact absorbing layer, said containment layer including a primary containment envelope having a front impact receiving side, a rear side, and first and second lateral sides, said primary containment envelope covering said impact receiving side, rear side, and first and second lateral sides of said impact absorbing layer, and said primary containment envelope being configured to minimize and contain fragmentation of said impact absorbing layer, said primary containment envelope including a containment resin matrix including a fibrous material and a ballistic adhesive compatible resin wrapped around said impact receiving side, rear side, and first and second lateral sides of said impact absorbing layer;

a composite backing layer having a front side and a rear side, the front side of said composite backing layer disposed over the rear side of said at least one primary containment envelope; and an energy absorbing layer secured to the rear side of said composite backing layer by a ductile adhesive layer disposed between said rear side of said composite backing layer and said energy absorbing layer, said ductile adhesive layer being composed of a fibrous material and a ballistic adhesive compatible resin, said ballistic adhesive compatible resin being selected from the group consisting of epoxy phenolic resin, vinyl ester resin, ultraviolet curing resins, thermoplastic resin, thermoset resin, polyethylene, ionomer resin, polypropylene, carbon fiber reinforced polyphenylene sulfide anti-ballistic resin, polyurea, and combinations thereof.

2. The multi-layered armor of claim 1, wherein said fragmenting material is subject to spalling when subjected to shock waves or shear forces of a ballistic impact.

3. The multi-layered armor of claim 1, wherein said fragmenting material comprises a ceramic formed of a material selected from a group consisting of silicon carbide, carbon/carbon composites, carbon/carbon/silicon carbide composites, boron carbide, aluminum oxide, silicon carbide particulate/aluminum metal matrix composites, and combinations thereof.

4. The multi-layered armor of claim 1, wherein said at least one composite backing layer comprises a backing layer resin matrix.

5. The multi-layered armor of claim 4, wherein said backing layer resin matrix comprises a fibrous material and a ballistic adhesive compatible resin, said fibrous material being selected from the group consisting of carbon fiber, fiberglass, aramid fiber, ultra high molecular weight polyethylene, and liquid crystal polymers.

6. The multi-layered armor of claim 1, wherein said energy absorbing layer comprises a material selected from the group consisting of uniwoven material, woven material, aramid fiber, ultra high molecular weight polyethylene, fiberglass, and polyethylene.

7. The multi-layered armor of claim 1, wherein said energy absorbing layer comprises a flame resistant layer.

8. The multi-layered armor of claim 7, wherein said flame resistant layer comprises a phenolic material.

9. The multi-layered armor of claim 1, wherein said monolithic plate is a flat planar plate.

10. A multi-layered armor stabilized to minimize fragmentation of the armor, comprising:

an impact absorbing layer having a front impact receiving side, a rear side, and first and second lateral sides, said impact absorbing layer including a monolithic plate of fragmenting material;

a containment layer covering said impact receiving side, rear side, and first and second lateral sides of said impact absorbing layer, said containment layer including a primary containment envelope having a front impact receiving side, a rear side, and first and second lateral sides, said primary containment envelope covering said impact receiving side, rear side, and first and second lateral sides of said impact absorbing layer, and said primary containment envelope being configured to minimize and contain fragmentation of said impact absorbing layer, said primary containment envelope including a containment resin matrix including a fibrous material and a ballistic adhesive compatible resin wrapped around said impact receiving side, rear side, and first and second lateral sides of said impact absorbing layer;

a composite backing layer disposed over at least one of said front impact receiving side and said rear side of said at least one primary containment envelope; and an energy absorbing layer secured to said composite backing layer by a ductile adhesive layer disposed between said energy absorbing layer and said composite backing layer, said energy absorbing layer including a flame resistant layer, wherein said ductile adhesive layer is formed of a material selected from the group consisting of a ballistic adhesive compatible resin, and a combination of a fibrous material and a ballistic adhesive compatible resin, said ballistic adhesive compatible resin being selected from the group consisting of epoxy phenolic resin, vinyl ester resin, ultraviolet curing resins, thermoplastic resin, thermoset resin, polyethylene, ionomer resin, polypropylene, carbon fiber reinforced polyphenylene sulfide anti-ballistic resin, polyurea, and combinations thereof.

11. A multi-layered armor stabilized to minimize fragmentation of the armor, comprising:

an impact absorbing layer having a front impact receiving side, a rear side, and first and second lateral sides, said impact absorbing layer including a monolithic plate;

a containment layer covering said impact receiving side, rear side, and first and second lateral sides of said impact absorbing layer, said containment layer including at least one primary containment envelope having a front impact receiving side, a rear side, and first and second lateral sides, said primary containment envelope covering said impact receiving side, rear side, and first and second lateral sides of said impact absorbing layer, and said primary containment envelope being configured to minimize and contain fragmentation of said impact absorbing layer, said primary containment envelope including at least one flame resistant adhesive coating on at least one of said front impact receiving side and said rear side of said impact absorbing layer, and a containment resin matrix including a fibrous material and a ballistic adhesive compatible resin wrapped around said impact receiving side, rear side, and first and second lateral sides of said impact absorbing layer;

a composite backing layer having a front side and a rear side, the front side of said composite backing layer disposed over said rear side of said at least one primary containment envelope; and an energy absorbing layer secured to the rear side of said composite backing layer by a ductile adhesive layer disposed between said rear side of said composite backing layer and said energy absorbing layer, said energy absorbing layer including a flame resistant layer including a phenolic material, wherein said ductile adhesive layer is formed of a material selected from the group consisting of a ballistic adhesive compatible resin, and a combination of a fibrous material and a ballistic adhesive compatible resin selected from the group consisting of epoxy phenolic resin, vinyl ester resin, ultraviolet curing resins, thermoplastic resin, thermoset resin, polyethylene, ionomer resin, polypropylene, carbon fiber reinforced polyphenylene sulfide anti-ballistic resin, polyurea, and combinations thereof.

* * * * *